US005611742A

United States Patent [19]

Kobayashi

[11] Patent Number: 5,611,742

[45] Date of Patent: Mar. 18, 1997

[54] WOOD-TYPE GOLF CLUB HEAD

[75] Inventor: Kenji Kobayashi, Tsubame, Japan

[73] Assignee: Kabushiki Kaisha Endo Seisakusho, Tsubame, Japan

[21] Appl. No.: 537,387

[22] Filed: Oct. 2, 1995

[30] Foreign Application Priority Data

Aug. 4, 1995 [JP] Japan ..... 7-199916

[51] Int. Cl.[6] ..... A63B 53/04

[52] U.S. Cl. ..... 473/345; 473/331; 473/349

[58] Field of Search ..... 273/167 H, 167 R, 273/78, 167 J, 167 F, 169, 77 R, 193 R, 194 R, 186.2, 175; 473/345, 331, 349

[56] References Cited

U.S. PATENT DOCUMENTS

| | | | |
|---|---|---|---|
| 4,214,754 | 7/1980 | Zebelean | 273/167 H |
| 4,398,965 | 8/1983 | Campau | 273/78 |
| 4,438,931 | 3/1984 | Motomiya | 273/167 H |
| 4,635,941 | 1/1987 | Yoneyama | 273/78 |
| 5,028,049 | 7/1991 | McKeighen | 273/167 H |
| 5,090,702 | 2/1992 | Viste | 273/175 |

FOREIGN PATENT DOCUMENTS

| | | | |
|---|---|---|---|
| 60-177867 | 11/1985 | Japan . | |
| 2-241469 | 9/1990 | Japan . | |
| 6-335540 | 12/1994 | Japan . | |
| 23750 | 1/1905 | United Kingdom | 273/78 |

*Primary Examiner*—Sebastiano Passaniti
*Attorney, Agent, or Firm*—Quarles & Brady

[57] ABSTRACT

An wood-type golf club head having plural cavities formed in a back surface of a head body. A back surface 1A of a metallic head body 1 is formed with plural cavities 5, opposite to a face 4 of the head body 1. The cavities 5 are formed by forging, thus generating even and fine metallic tissues and grain flow. Accordingly, the toughness and durability of the material can be enhanced, so that face 4 can be made thinner to a 1.0 to 3.5 mm thickness for realizing an optional weight distribution. As a result, a larger sweet area can be realized without damaging a strength of head.

6 Claims, 7 Drawing Sheets

FIG. 11
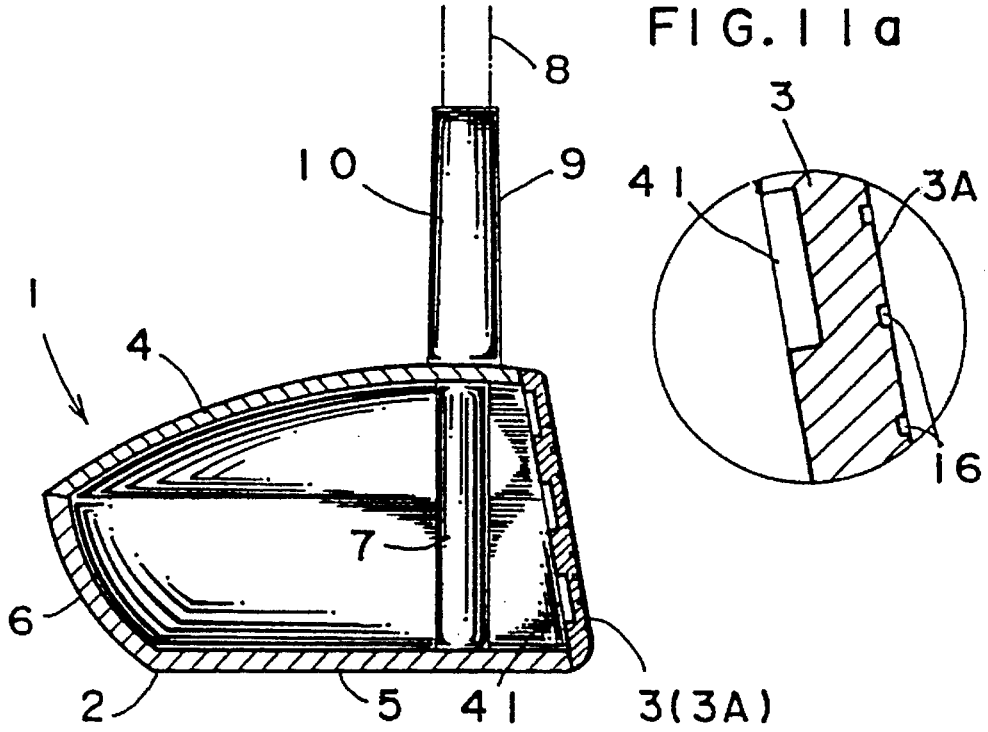
FIG. 11a
FIG. 12
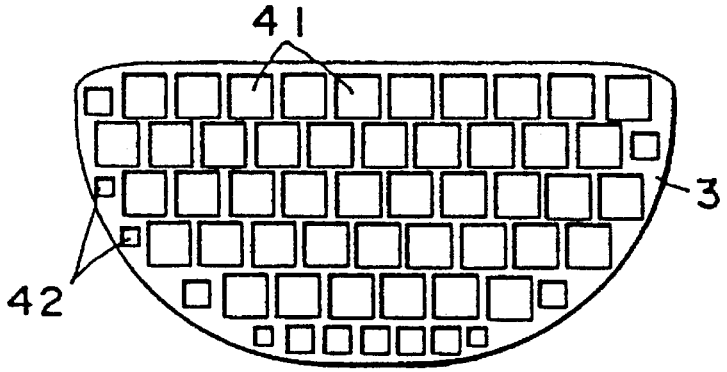

WOOD-TYPE GOLF CLUB HEAD

BACKGROUND OF THE INVENTION (a) Field of the Invention

The present invention relates to a wood-type golf club head obtained by integraly joining a plurality of metallic shells.

(b) Description of Prior Art

For this kind of golf club head, there is proposed a wood-type golf club head disclosed in Japanese Patent Appln Laid-Open No. 6-335540, which discloses in FIGS. 1 and 2, a hollow wood-type golf club head obtained by integrally joining a main body made of titanium or titanium alloy having a shell-like sole and side-peripheral surface, a face member and a crown member. Such prior golf club head is advantageous when enlarging a sweet area because such a hollow structure of the main body enables the enlarging of the volume thereof. Further, there is also proposed another golf club head disclosed in Japanese U.M. Appln Laid-Open No. 60-177867, which discloses in FIG. 2, a golf club head having plural cavities in its back. The prior golf club head aimed at decreasing air resistance when swinging the same by forming plural cavities in the back of the head body which had been conventionally formed smooth. Additionally, there is further proposed another golf club head disclosed in Japanese Patent Appln Laid-Open No. 2-241469, which discloses in FIG. 1, a wood-type golf club head having small cavities formed along a peripheral portion of the head body by cutting process, thereby enchancing a sense of beauty.

Whereas, it is widely recognized that for enlargement of so-called a sweet area, a wood-type golf club head (hereinafter called head) should have an elongated distance between the CG of the head body and the face. However, according to the prior golf club heads, the face must be formed to a preset thickness because of the requirement for the strength thereof at the time of striking balls, therefore, a predetermined weight would be inevitably required for thickening the face. As a result, there has been a problem such that a golf club head cannot be formed as you like.

SUMMARY OF THE INVENTION

To eliminate the above-mentioned problems, it is, therefore, an object of the present invention to provide a wood-type golf club head of which the face can be still optionally formed when forming the face thinner.

According to a major feature of the present invention, there is provided a wood-type golf club head comprising a plurality of cavities formed in a back surface of a face shell, said cavities being formed by forging.

BRIEF DESCRIPTION OF THE DRAWINGS

Other objects, features and advantages of the invention will be apparent to those skilled in the art from the following description of the preferred embodiments of the invention, wherein reference is made to the accompanying drawings, of which:

FIG. 1*a* is an enlarged view of a section of FIG. 1.

FIG. 7*a* is an enlarged view of a section of FIG. 7.

FIG. 11 is a section showing a fourth embodiment of the invention.

FIG. 11*a* is an enlarged view of a section of FIG. 11.

FIG. 12 is a rear view showing a face member of a fourth embodiment of the invention.

DETAILED DESCRIPTION OF THE PREFERRED EMBODIMENTS

Figure 1:
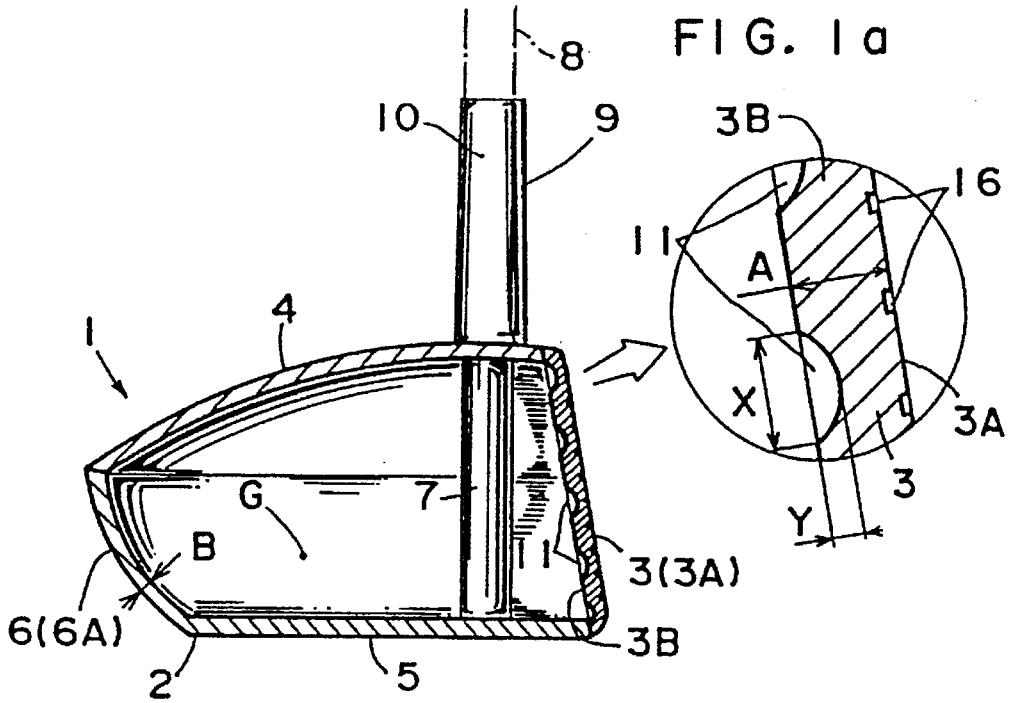
FIG. 1 is a section showing a first embodiment of the invention.
Figure 2:
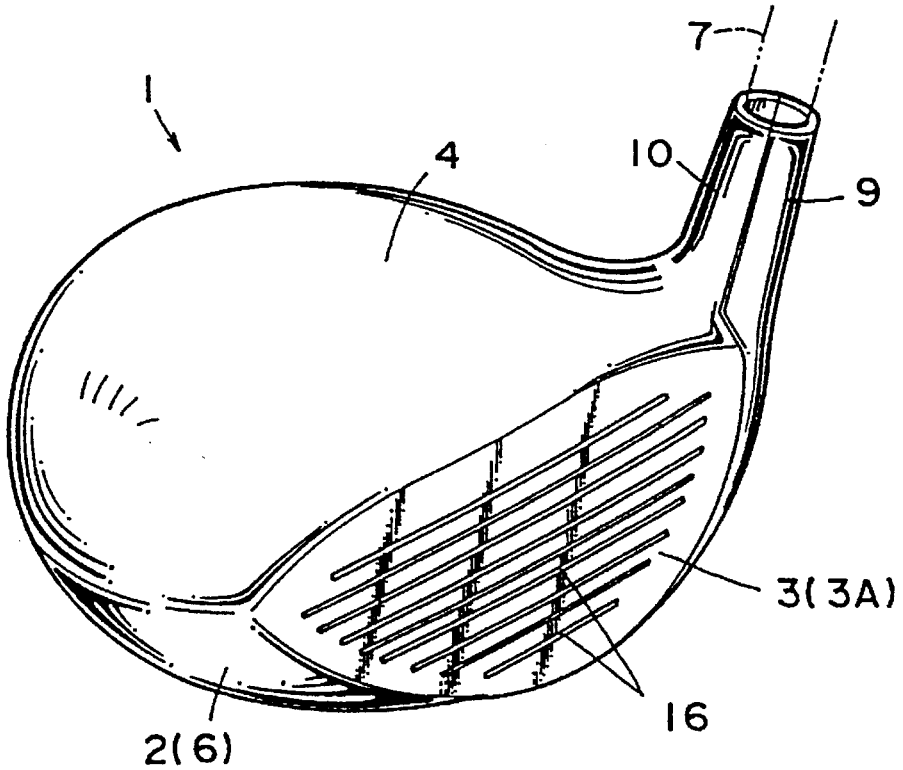
FIG. 2 is a perspective view showing a first embodiment of the invention.
Figure 3:
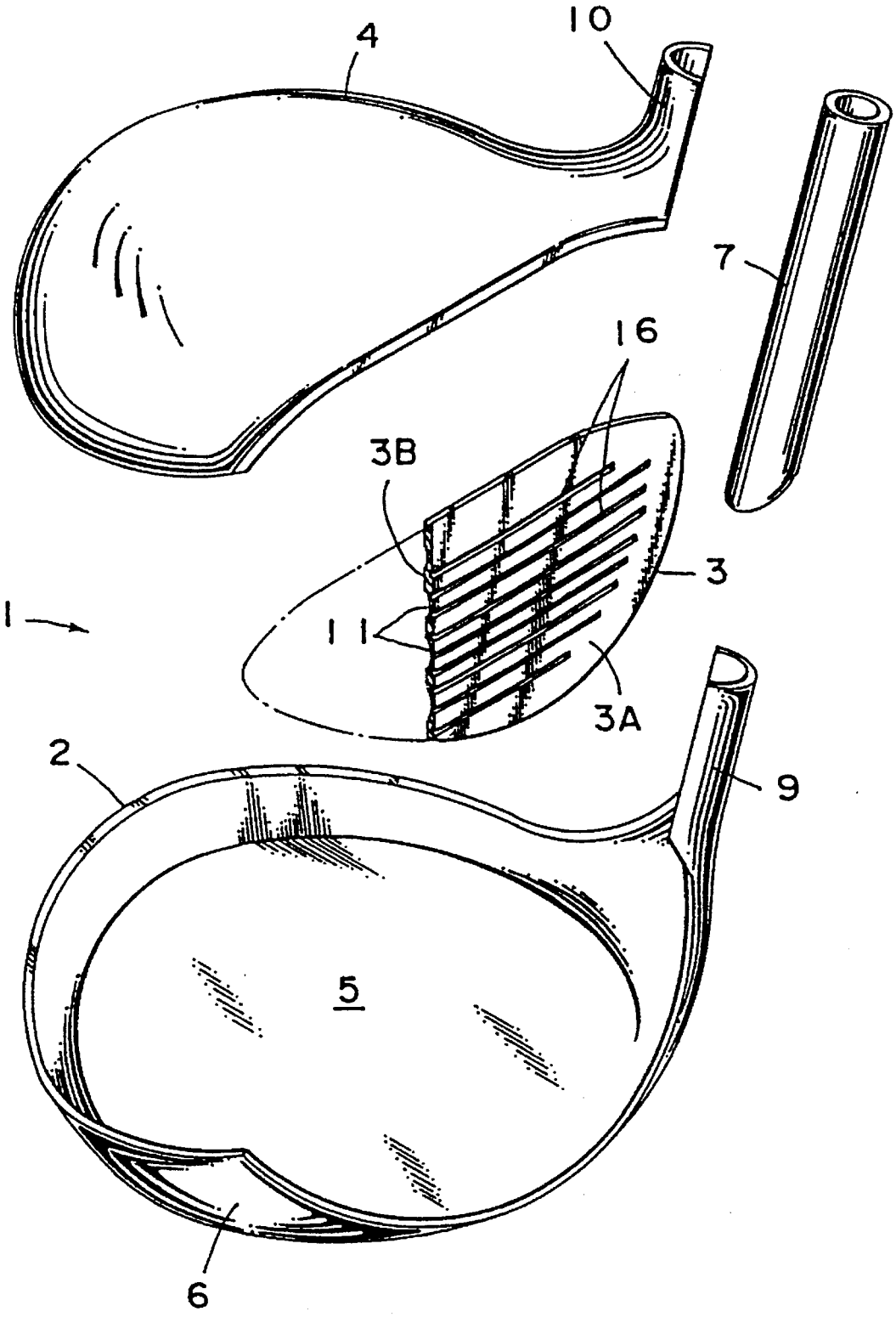
FIG. 3 is an exploded perspective view showing a first embodiment of the invention.

Hereinafter is described a first embodiment of the invention with reference to FIGS. 1 to 4, in which reference numeral 1 designates a metallic head. The hollow metallic head 1 is obtained by integraly uniting a head body 2, a face member 3 and a crown member 4, each of which being metallic and shell-shaped, formed of titanium or titanium alloy, or steel products such as carbon steels for machine structural use by means of forging process. In a preferred form of the invention, titanium or titanium alloy may be chosen as the material because of their less specific gravity which would be useful for enlargement of the volume of the head. The head body 2 comprises a sole 5 and a side-peripheral portion 6 integral with each other, further comprising a half hosel 9 obliquely extending therefrom for mounting a shaft 8 thereto through a mounting pipe 7. Whilst, the crown member 4 is integrally formed with the other half hosel 10.

The face member 3 has a striking face 3A at its front surface, while a back surface 3B thereof is formed with plural semishpherical cavities 11 and 12, which are of different diameters and formed rather dense.

Figure 4:
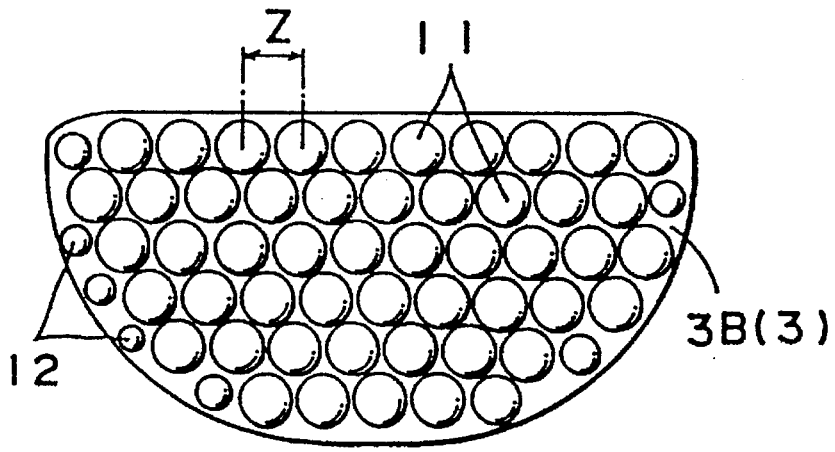
FIG. 4 is a rear view showing a face member of a first embodiment of the invention.

Each of the cavities 11 and 12 has a diameter X of 3 to 8 mm, preferably 5 to 6 mm, a depth Y of 0.2 to 1.7 mm, preferably 0.7 to 1.2 mm, while a center to center distance Z between adjacent cavities 11,12 is 3 to 10 mm, preferably 5 to 7 mm. In addition, a percentage area of all the cavities 11 and 12 to said back surface 3B is preferably 70% or above. As shown in FIG. 4, the cavities comprise adjacent rows of upper and lower cavities in a staggered design. As each rank of cavities is offset by one half pitch approximately equal to a radius of each cavity, the cavities can be extremely densely formed.

Figure 5:
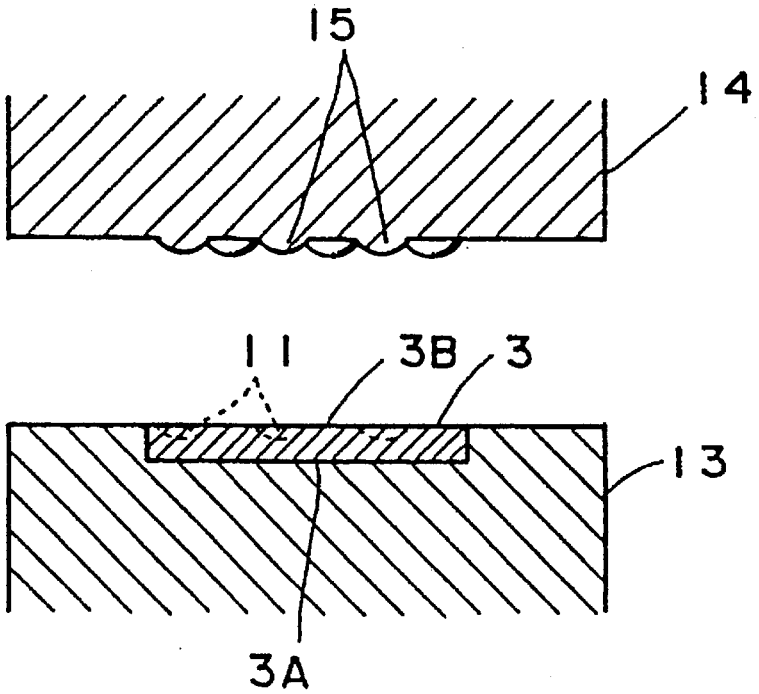
FIG. 5 is an explanatory section showing a manufacturing method for a first embodiment of the invention.

Referring to FIG. 5, which is an explanatory diagram illustrating a method for manufacturing the cavities 11 and 12. The face member 3 forged beforehand, having the flat back surface 3B, is placed in a forging lower die 13, while an upper die 14 is formed with plural semispherical protrusions 15 for forming said plural cavities 11 and 12. Then, the upper die 13 is pressed toward the flat back surface 3B, thus simultaneously forming said plural cavities by means of cold forging.

Next, said head body 2, face 3 and crown 4 are jointed by welding each edge thereof one another, and then, the half hosels 9 and 10 are joined, thus inserting a shaft mounting pipe 7 thereinto. After the hollow head 1 is thus constructed, the face 3A is formed with grooves 16 and/or polished to a final product. Incidentally, reference numeral 16 designates grooves called score lines formed on the face 3A. Where necessary, the hollow portion of the head 1 may be charged with suitable foam material such as urethane.

According to a first embodiment of the invention, the back surface 3B of the face member 3 is formed with a plurality of cavities 11 and 12 by forging, whereby the face 3 can be strengthened thus enabling the face 3 to be formed thinner to a 1.0 to 3.5 mm thickness. As a result, you can allot a surplus weight thus obtained to other parts of the head 1, for example, to a back portion 6A of the side-peripheral shell 6 in order to make the thickness B thereof greater, thereby elongating the distance between the CG of the head 1 and the face 3A to enlarge a sweet area.

Table 1 shown below indicates the contrast between the results of the tensile test wherein the plates formed with the equivalents to the cavities 11,12 (sample Nos. 3 and 4) were compared to the plates without the same (sample Nos. 1 and 2). Further, the Table 1 also shows the contrast between the results of the bending test wherein the plate formed with the equivalents to the cavities 11,12 (sample No. 2) was compared to the plate without the same (sample No. 1).

6,370 N, while that of the plate without the cavities (sample No. 1) 4,288 N, which indicated that the forming of the cavities could increase the bending strength by 48.5%. Such improvement of the strength presumably results from the enhanced toughness and durability of the material associated with the formation of even and fine tissues and grain flows by forming cavities by means of forging. In addition, the cavities 11,12 Were formed semispherical, the above-mentioned grain flows are hard to disconnect, thereby further improving the strength.

In FIGS. 6 to 8, 9 to 10, 11 to 12 showing second to fourth embodiments respectively, the same portions as those described in a first embodiment will be designated as common reference numerals, and their repeated detailed description will be omitted.

Figure 6:
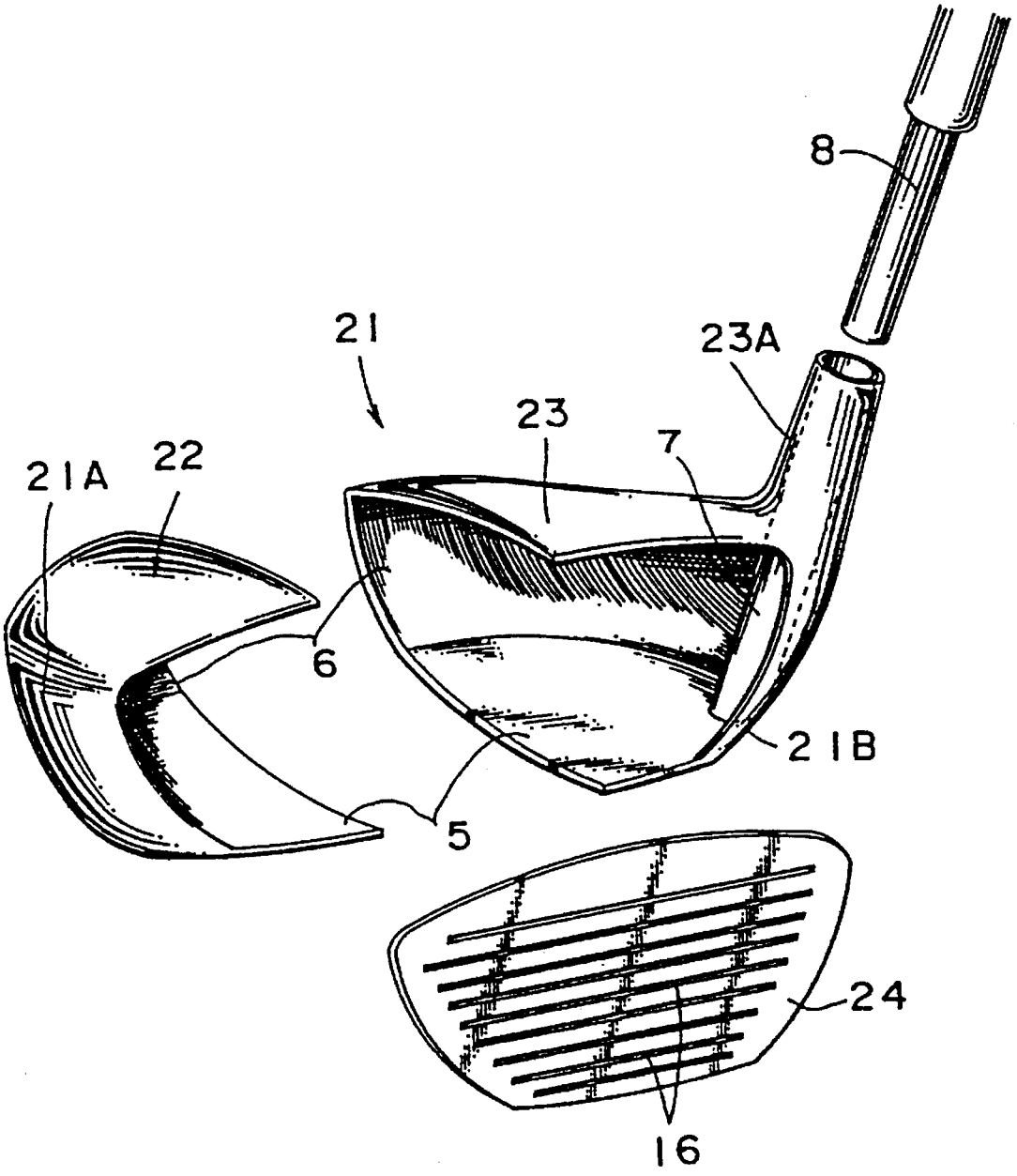
FIG. 6 is an exploded perspective view showing a second embodiment of the invention.
Figure 7:
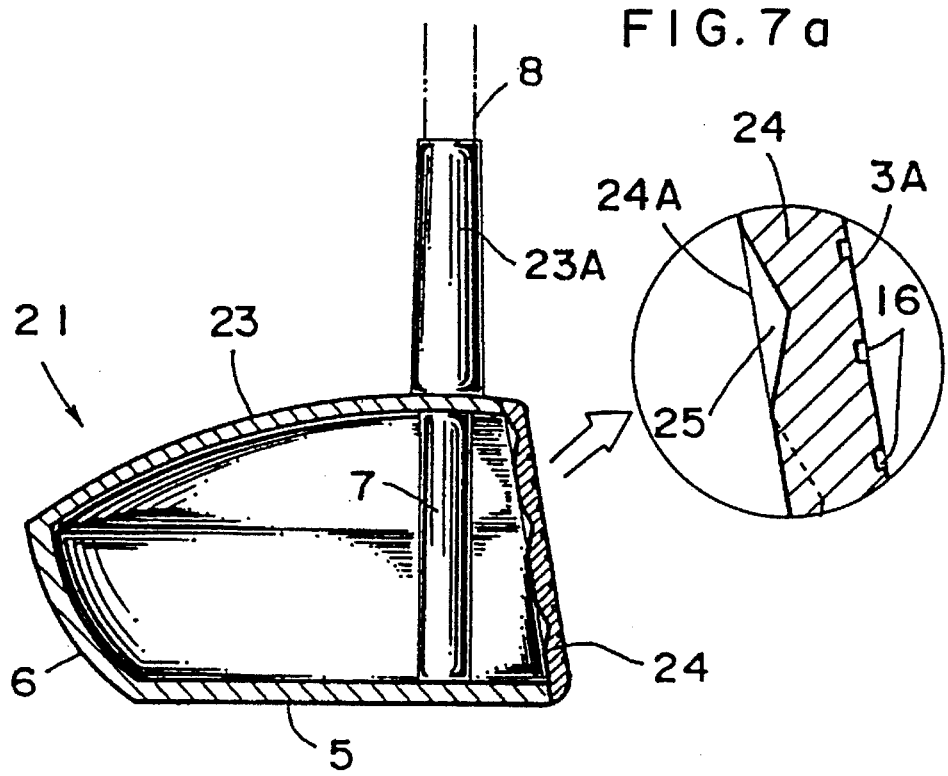
FIG. 7 is a section showing a second embodiment of the invention.
Figure 8:
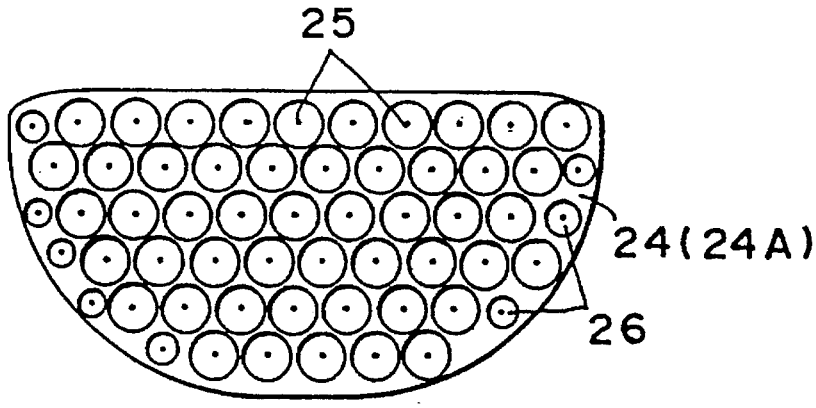
FIG. 8 is a rear view of a face member of a second embodiment of the invention.

Referring to FIGS. 6 and 8 showing a second embodiment, a head 21 basically comprises three pieces consisting of a top-side shell 22 forming a top 21A of the head 21, a heel-side shell 23 forming forming a heel 21B and a face shell 24. To a hosel 23A of the heel-side shell 23 is connected a shaft 8 through a mounting pipe 7. A back surface 24A of the face member 24 is formed with cone-shaped cavities 25 of larger diameters and 26 of smaller diameters by forging. Thus, the face member 24 can be strengthened and formed thinner, whereby an optional weight distribution can be realized in the head 21. In addition, the cavities 25 and 26 are of the different diameters, whereby they are capable of being densely formed in the back surface 24A owing to the above difference in diameter.

Figure 9:
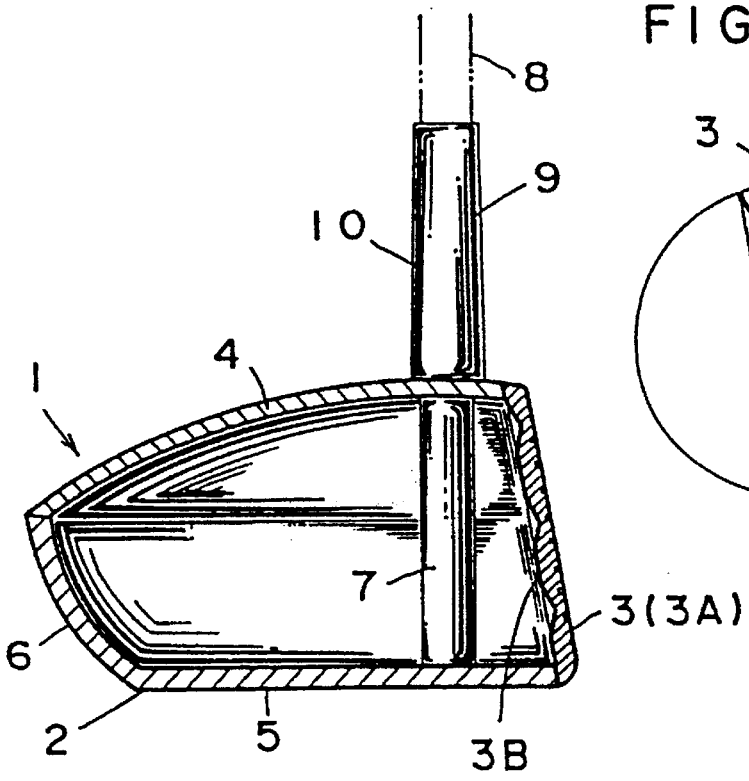
FIG. 9 is a section showing a third embodiment of the invention.
Figure 9A:
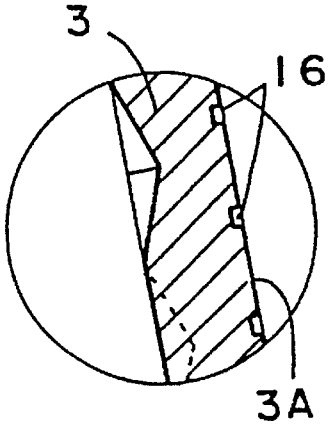
FIG. 9*a* is an enlarged view of a section of FIG. 9.
Figure 10:
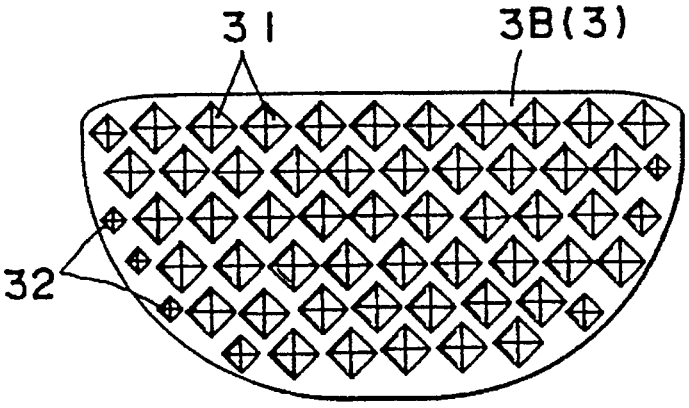
FIG. 10 is a rear view showing a face member of a third embodiment of the invention.

Referring to FIGS. 9 and 10 showing a third embodiment, the back surface 3B of the face 3 is formed with pyramid-

TABLE 1

Tensile Test

| | | | test piece | | | tensile | | yield | | | |
|---|---|---|---|---|---|---|---|---|---|---|---|
| No. | sample No. | material | dimension mm | cross-sectional area mm² | original gauge length mm | load N | tensile strength N/mm² | load N | yield point N/mm² | yield elongation % | reduction of area % |
| 1 | 1 | S20C | 5.8 × 24.5 | 142.1 | 49.9 | 75096 | 528.5 | 52920 | 372.4 | 34.1 | — |
| 2 | 2 | " | 6.0 × 24.3 | 145.8 | 49.6 | 73619 | 504.9 | 54517 | 374.0 | 35.5 | — |
| 3 | 3 | " | 5.8 × 24.5 | 142.1 | 50.1 | 90866 | 639.5 | 63337 | 445.7 | 2.0 | — |
| 4 | 4 | " | 5.8 × 24.4 | 141.5 | 50.0 | 91457 | 646.3 | 62475 | 441.5 | 2.6 | — |

Bending Test

| | | | test piece | | | | | result crack | |
|---|---|---|---|---|---|---|---|---|---|
| No. | sample No. | material | cross-sectional dimension mm | length mm | angle of bend (deg.) | inside radius mm | bearing distance mm | on the outer periphery of the bent piece | remark |
| 1 | 1 | S20C | 5.9 × 20.0 | 149.8 | 180 | 12 | 36 | none | deformation - starting load note 1): 4288N |
| 2 | 2 | " | 5.9 × 19.6 | 151.0 | 180 | " | " | fractured | deformation - starting load note 1): 6370N |

notes.
note 1)
deformation - starting load was assumed to be a proportional limit in a load-elongation diagram.

According to the result of the tensile test in Table 1, the average tensile strength of the plates with the cavities (sample Nos. 3 and 4) was 642.2 N/mm, while that of the plates without the cavities (sample Nos. 1 and 2) 516.7 N/mm, which indicated that the forming of the cavities could increase the tensile strength by 24.4%. Whilst, according to the result of the bending test in Table 1, the deformation-starting load of the plate with the cavities (sample No. 2) was shaped cavities 31 and 32 having different dimensions, thereby forming denser cavities as well.

Referring to FIGS. 11 and 12 showing a fourth embodiment, the back surface 3B of the face 3 is formed with cavities 41 and 42 having different rectangular sections, thereby forming denser cavities as well.

Incidentally, the present invention should not be limited to the above embodiments, but may be modified within a scope of the invention.

As is evident from the above descriptions, according to the present invention, face can be strengthened when you diminish the thickness thereof, owing to the cavities formed by forging. Accordingly, there can be provided a wood-type golf club head where the diminished thickness of face enables the allotting of the surplus weight thus obtained to other parts of head body, whereby a sweet area can be enlarged and optional weight distribution in head can be realized. In addition, as face is formed within a range of 1.0 to 3.5 mm thickness, the above-described advantages can be effectively attained.

What is claimed:

1. A wood-type golf club head formed by integrally joining a plurality of metallic shells including a face shell, having a face at a front side and a shaft mounting portion at one side, comprising:

a plurality of cavities formed in a back surface of said face shell, each of said cavities being formed by forging, having a uniform semispherical concave portion which has a circular-shaped plan view, each having a depth relatively less than its width to form a relatively shallow cavity structure, wherein said plural cavities comprise multi-stage ranks which are each offset by half a pitch respectively.

2. A wood-type golf club head according to claim 1, wherein a thickness of said face is within a range from 1.0 to 3.5 mm.

3. A wood-type golf club head according to claim 1, wherein each width of said cavities is within a range from 3.0 to 8.0 mm, while each depth thereof is 0.2 to 1.7 mm.

4. A wood-type golf club head according to claim 1, wherein a center to center distance between the adjacent cavities is within a range from 3 to 10 mm.

5. A wood-type golf club head according to claim 1, wherein a percentage area of said cavities to a flat portion of a back surface of said face is 70% or above.

6. A wood-type golf club head according to claim 1, further comprising a plurality of relatively small cavities provided along a peripheral edge of the back of the face member.

* * * * *